US011944223B2

(12) United States Patent
Xu

(10) Patent No.: US 11,944,223 B2
(45) Date of Patent: Apr. 2, 2024

(54) CURTAIN ROD HANGING STRUCTURE

(71) Applicants: Jiaxiang Xu, Zhejiang (CN); Bo Liu, Zhejiang (CN)

(72) Inventor: Jiaxiang Xu, Zhejiang (CN)

(73) Assignees: Jiaxiang Xu, Hangzhou (CN); Bo Liu, Hangzhou (CN)

( * ) Notice: Subject to any disclaimer, the term of this patent is extended or adjusted under 35 U.S.C. 154(b) by 58 days.

(21) Appl. No.: 17/565,440

(22) Filed: Dec. 29, 2021

(65) Prior Publication Data

US 2023/0138957 A1 May 4, 2023

Related U.S. Application Data

(63) Continuation of application No. PCT/CN2021/127630, filed on Oct. 29, 2021.

(51) Int. Cl.
*A47H 1/122* (2006.01)

(52) U.S. Cl.
CPC ..... *A47H 1/122* (2013.01)

(58) Field of Classification Search
CPC ..... A47H 1/122
See application file for complete search history.

(56) References Cited

U.S. PATENT DOCUMENTS 2,496,478 A * 2/1950 Kinnebrew ..... A61J 9/0661 248/103
3,112,910 A * 12/1963 Francois ..... A01K 97/10 248/161
3,858,833 A * 1/1975 Fink ..... A01K 97/10 248/533
3,926,303 A * 12/1975 McCall ..... B65G 17/20 105/154
4,032,096 A * 6/1977 Perrault ..... F16L 3/243 248/220.21
5,542,631 A * 8/1996 Bruno ..... F16L 3/133 248/62
5,911,523 A * 6/1999 Burchart ..... G09F 7/205 40/607.04
7,429,020 B2 * 9/2008 Huebner ..... F16L 3/14 248/58

(Continued)

FOREIGN PATENT DOCUMENTS

CN 203290684 U 11/2013
CN 208957599 U 6/2019

(Continued)

OTHER PUBLICATIONS

European Search Report of European Patent Application No. 21827523.8 dated Mar. 15, 2023.

*Primary Examiner* — Anita M King

(57) ABSTRACT

The present application relates to a curtain rod hanging structure, which includes a vertical rod and a hook body, the hook body is provided on the vertical rod, an installation groove is provided on the inner wall of the hook body, and an adjusting pad is detachably arranged in the installation groove and the adjusting pad is configured to hang the curtain rod. The present application realizes hanging curtain rods with different diameters by replacing the adjusting pad in the installation groove, eliminating the need of replacing the overall curtain rod hanging structure and providing the effect of facilitating the installation and high applicability.

7 Claims, 7 Drawing Sheets

(56) References Cited

U.S. PATENT DOCUMENTS

| | | | | |
|---|---|---|---|---|
| 7,513,467 | B1 * | 4/2009 | Hurley | B60J 1/20 248/291.1 |
| 7,775,491 | B1 * | 8/2010 | Samu | G10G 5/00 248/339 |
| 10,799,055 | B2 * | 10/2020 | McNabb | A47H 1/14 |
| 2020/0345167 | A1 | 11/2020 | Klowan et al. | |

FOREIGN PATENT DOCUMENTS

| | | | |
|---|---|---|---|
| CN | 209219886 | U | 8/2019 |
| CN | 211324263 | U | 8/2020 |
| CN | 212465681 | U | 2/2021 |
| CN | 212678904 | U | 3/2021 |
| DE | 20210245 | U1 | 10/2002 |
| ES | 290434 | U | 3/1986 |
| KR | 101235354 | B1 | 2/2013 |

* cited by examiner

--Prior Art--

CURTAIN ROD HANGING STRUCTURE

CROSS-REFERENCE TO RELATED APPLICATION

This application is a continuation of PCT application no. PCT/CN2021/127630, filed on Oct. 29, 2021. The entirety of the above-mentioned patent application is hereby incorporated by reference herein and made a part of this specification.

TECHNICAL FIELD

The present application relates to a field of curtain installation and particular to a curtain rod hanging structure.

BACKGROUND ART

When installing the curtain, a hanging structure is required for installing the curtain rod, and then the curtain is installed on the curtain rod.

Referring to FIG. 1, the curtain rod hanging structure in the related technology includes a vertical rod 1 and a hook body 2, in which the vertical rod 1 is fixedly connected with the ceiling and the hook body 2 is fixedly connected with the end of the vertical rod 1 away from the ceiling. The hook body 2 is used to hang the curtain rod.

In view of the above-mentioned related technology, it is found that there is following deficiency: when the operator needs to hang curtain rods with different diameters, the operator needs to dismantle the vertical rod and the hook body from the ceiling, and then install a matched hook body on the ceiling, incurring inconvenient installation for the operator.

SUMMARY

In order to facilitate the installation of curtain rods with different diameters for an operator, the present application provides a curtain rod hanging structure.

A curtain rod hanging structure provided in the present application adopts the following technical solution.

A curtain rod hanging structure includes a vertical rod and a hook body, the hook body is provided on the vertical rod, an installation groove is provided in an inner wall of the hook body, and an adjusting pad is detachably arranged in the installation groove and configured to hang the curtain rod.

With the above technical solution, when in use, the operator removes the adjusting pad from the installation groove, and replaces an adjusting pad which is adapted to the corresponding curtain rod. The operator only needs to replace the adjusting pad to realize the installation of curtain rods with different diameters, which facilitate the operation for the operator.

Optionally, the adjusting pad is elastic, and is snap connected in the installation groove.

With the above technical solution, when in use, the operator only needs to bend the adjusting pad and removes the adjusting pad out of the installation groove, which facilitate the replacement the adjusting pad for operator.

Optionally, a plurality of anti-slip grooves are provided in a sidewall of the adjusting pad close to an inner wall of the hook body.

With the above technical solution, the friction force between the adjusting pad and the inner wall of the hook body is increased by providing the anti-slip grooves, so as to reduce the occurrence of detaching of the adjusting element from the installation groove during use.

Optionally, the vertical rod includes a fixing tube and a sliding rod, in which the sliding rod is slidably connected inside the fixing tube, and the sliding rod is in friction connection with the inner wall of the fixing tube, and the hook body is arranged on the sliding rod.

With the above technical solution, when installing, the operator can realize the height adjustment of the curtain rod by adjusting the position of the sliding rod relative to the fixing tube, so as to further facilitate the installation for operator.

Optionally, the fixing tube is provided with an installation assembly, the installation assembly includes an installation plate and a fixing screw, the installation plate is provided with a plurality of installation through-holes and the fixing screw is threadedly connected on the installation plate, the fixing screw penetrates the installation plate and the fixing tube is threadedly connected with the fixing screw.

With the above technical solution, when installing the fixing tube in a room, the expansion bolt is passed through the installation through-hole by the operator, so as to install the installation plate in the room, and then the fixing tube is threadedly connected with the fixing screw to realize the installation of the fixing tube in the house, which facilitate the installation for operator.

Optionally, a rubber ring is provided on the outer sidewall of the sliding rod, and the outer wall of the rubber ring abuts against the inner wall of the fixing tube.

With the above technical solution, the rubber ring abutting against the inner wall of the fixing tube achieves a damping effect between the sliding rod and the fixing tube, so that the structure is simple.

Optionally, a connecting tube is provided on the sidewall of the fixing tube, the connecting tube is communicated with the fixing tube, a unidirectional structure is provided in the connecting tube, the unidirectional structure includes a unidirectional tapered body and an unidirectional spring for keeping the directional tapered body closing the connecting tube, the unidirectional tapered body is slidably connected in the connecting tube in the direction approaching or departing from the fixing tube, and the outer diameter of the unidirectional tapered body is gradually increased along the direction from the fixing tube to connecting tube.

With the above technical solution, when installing the fixing tube, the operator threadedly connects the fixing tube with the fixing screw, so that air or medium between the fixing screw and the sliding rod can drive the sliding rod to slide to the farthest position in the fixing tube. For adjusting the relative position between the sliding rod and the fixing tube, the operator presses the sliding rod into the fixing tube, so that air or medium between the fixing screw and the sliding rod drives the unidirectional tapered body to move in the direction away from the fixing tube, so as to compress the unidirectional spring. After adjusting, the unidirectional spring drives the unidirectional tapered body to move in the direction approaching the fixing tube, so that the unidirectional tapered body closes the connecting tube. This realizes the effect that the relative position between the sliding rod and the fixing tube will not change when the operator pulls the curtain to improve the overall stability during use, since the external air is blocked by the unidirectional tapered body.

Optionally, a closing assembly is provided between the connecting tube and the fixing tube, the closing assembly includes a tapered closing body, a return spring for keeping the tapered closing body closing the communicating portion between the connecting tube and the fixing tube, and a driving structure for driving the tapered closing body to move in the direction away from the connecting tube, and the outer diameter of the tapered closing body is gradually decreased along the direction from the fixing tube to the connecting tube.

During the threaded connecting of the fixing tube to the fixing screw, air between the sliding rod and the fixing screw can be discharged out of the unidirectional tapered body, so that it is difficult for the fixing tube to drive the sliding rod to move during the threaded connecting of the fixing tube to the fixing screw.

With the above technical solution, during the threaded connecting of the fixing tube to the fixing screw, the return spring and the tapered closing body close the communicating portion between the connecting tube and the fixing tube, so as to reduce the possibility of the air between sliding rod and the fixing screw leaking out of the connecting tube. The sliding rod drives the tapered closing body to move in the direction away from the connecting tube when sliding to the limit position in the fixing tube, so that the communicating portion between the connecting tube and the fixing tube is opened, which facilitates the fixing tube to drive the sliding rod to move during the threaded connecting of the fixing tube to the fixing screw.

Optionally, the driving structure includes a driving ring, the driving ring is arranged at the tail of the fixing screw, and the driving ring is configured to abut against the sidewall of the tapered closing body.

With the above technical solution, during the threaded connecting of the fixing tube to the fixing screw, the driving ring moves in the direction approaching the tapered closing body, so that the driving ring abuts against the sidewall of the tapered closing body, and the driving ring drives the tapered closing body to move in the direction away from the connecting tube. This realizes the movement of the tapered closing body in the direction away from the connecting tube during the threaded connecting of the fixing tube to the fixing screw, so that the structure is simple.

Optionally, a leveling assembly is provided in the connecting tube, the leveling tube includes a transparent box, a partition plate, a first sliding plate and a second sliding plate, the partition plate is fixedly connected inside the transparent box, the partition plate divides the transparent box into two cavities, that is, a first cavity and a second cavity, respectively, the first sliding plate is slidably connected inside the first cavity, the second sliding plate is slidably connected inside the second cavity, a first communicating pipe is communicated with the bottom of the first cavity inner wall, a second communicating pipe is communicated with the bottom of the second cavity inner wall, and the first communicating pipe is configured to communicate with the connecting tube.

With the above technical solution, when in use, two fixing tubes are threadedly connected to two fixing screws respectively by the operator to realize the installation of the curtain rod hanging structure in the room. Air between the fixing screw and the sliding rod drives the sliding rod to move to the limit position, so as to realize "zero adjustment" of the sliding rod. Air inside the fixing tube is discharged through unidirectional tapered body under air pressure. After the air pressure in the fixing tube is stabilized, the first communicating pipe is communicated with one of the connecting tubes, and the second communicating pipe is communicated with the other of the connecting tubes. When adjusting the extension length of one sliding rod, air between the sliding rod and the fixing screw is discharged from the fixing tube through unidirectional tapered body, and then enters the first cavity through first communicating pipe, so that the first sliding plate in the first cavity moves upward vertically. When adjusting the extension length of another sliding rod, air between the sliding rod and the fixing screw is discharged from fixing tube through unidirectional tapered body, and then enters the second cavity through second communicating pipe, so that the second sliding plate in the second cavity moves upwards vertically. The operator only needs to observe and compare the heights of the first sliding plate and the second sliding plate to control the extension length of two sliding rods, which facilitates the leveling of the curtain rod for operator.

In conclusion, the present application achieves at least one following beneficial effect:

1. it is convenient for an operator to replace the curtain rods with different diameters through installation groove and adjusting pad;
2. it is convenient for the operator to install the fixing tube in the room through the installation assembly;
3. the occurrence of driving the sliding rod out when the operator pulls the curtain is reduced through the unidirectional structure and closing assembly, which improves the overall stability of the structure; and
4. it is convenient for the operator to level the curtain rod through the leveling assembly.

DETAILED DESCRIPTION

The present application is further described in detail below in combination with FIG. 2-FIG. 7.

The embodiments of the present application disclosure a curtain rod hanging structure.

Embodiment 1

Figure 1:
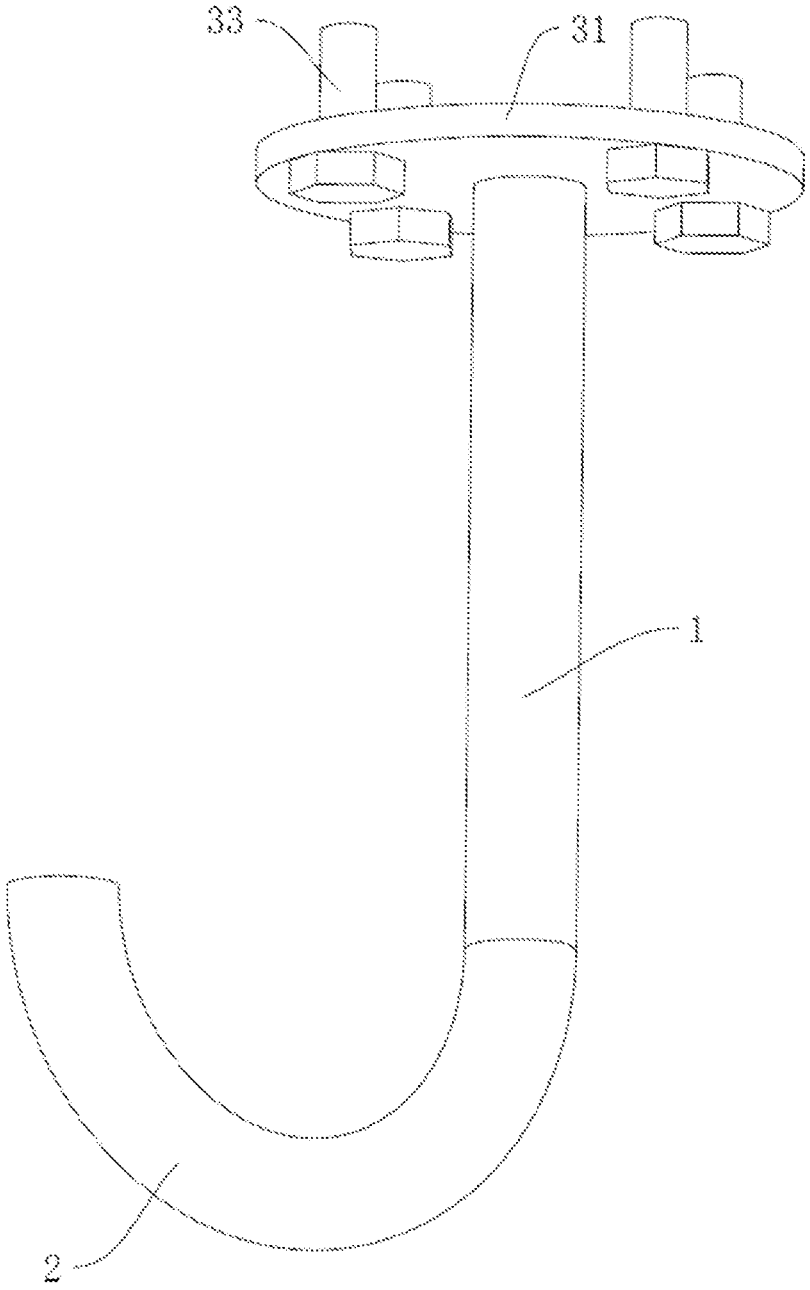
FIG. 1 is a schematic structural diagram of a related technology.
Figure 2:
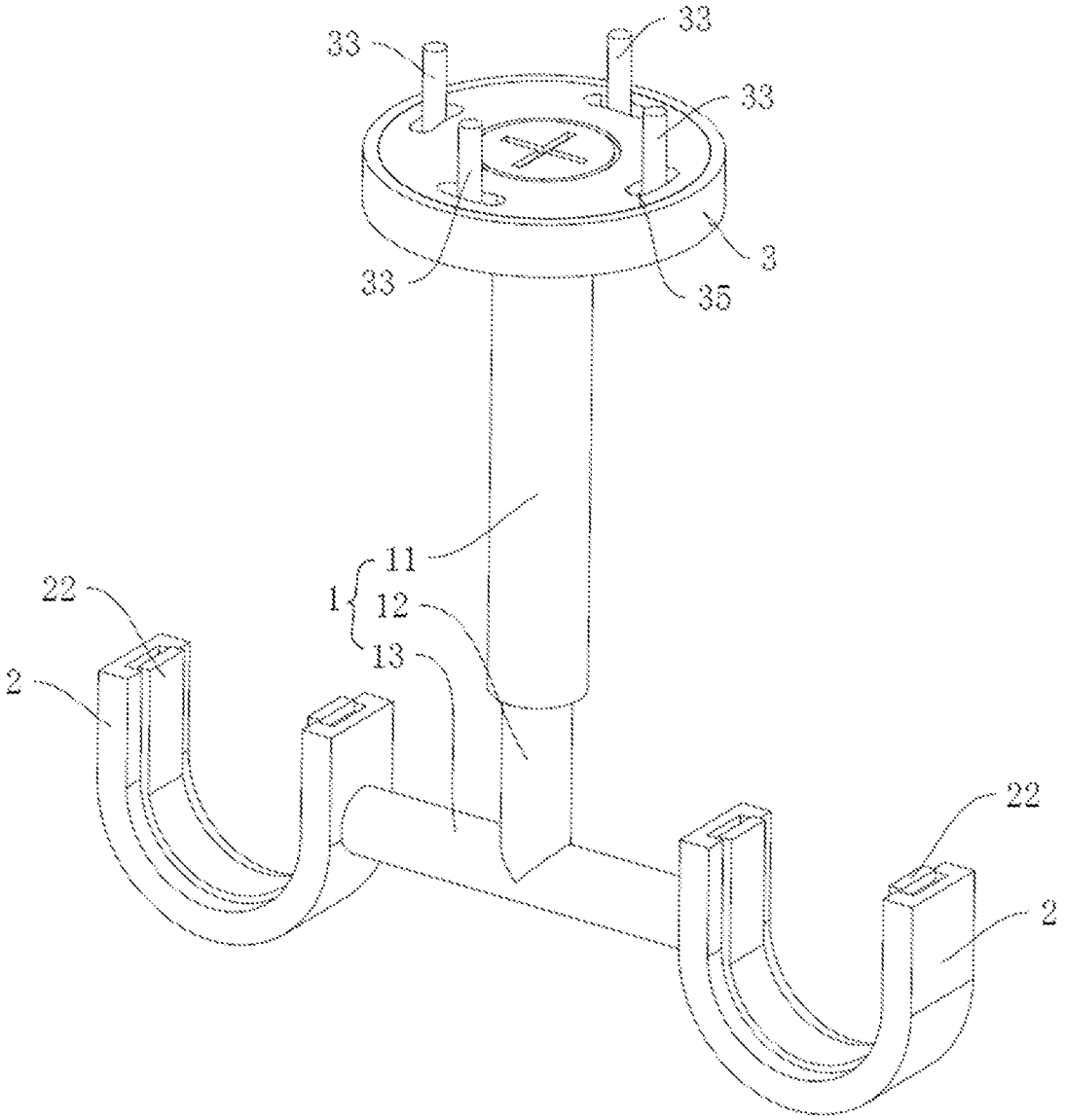
FIG. 2 is a schematic structural diagram of Embodiment 1 in the present application.
Figure 3:
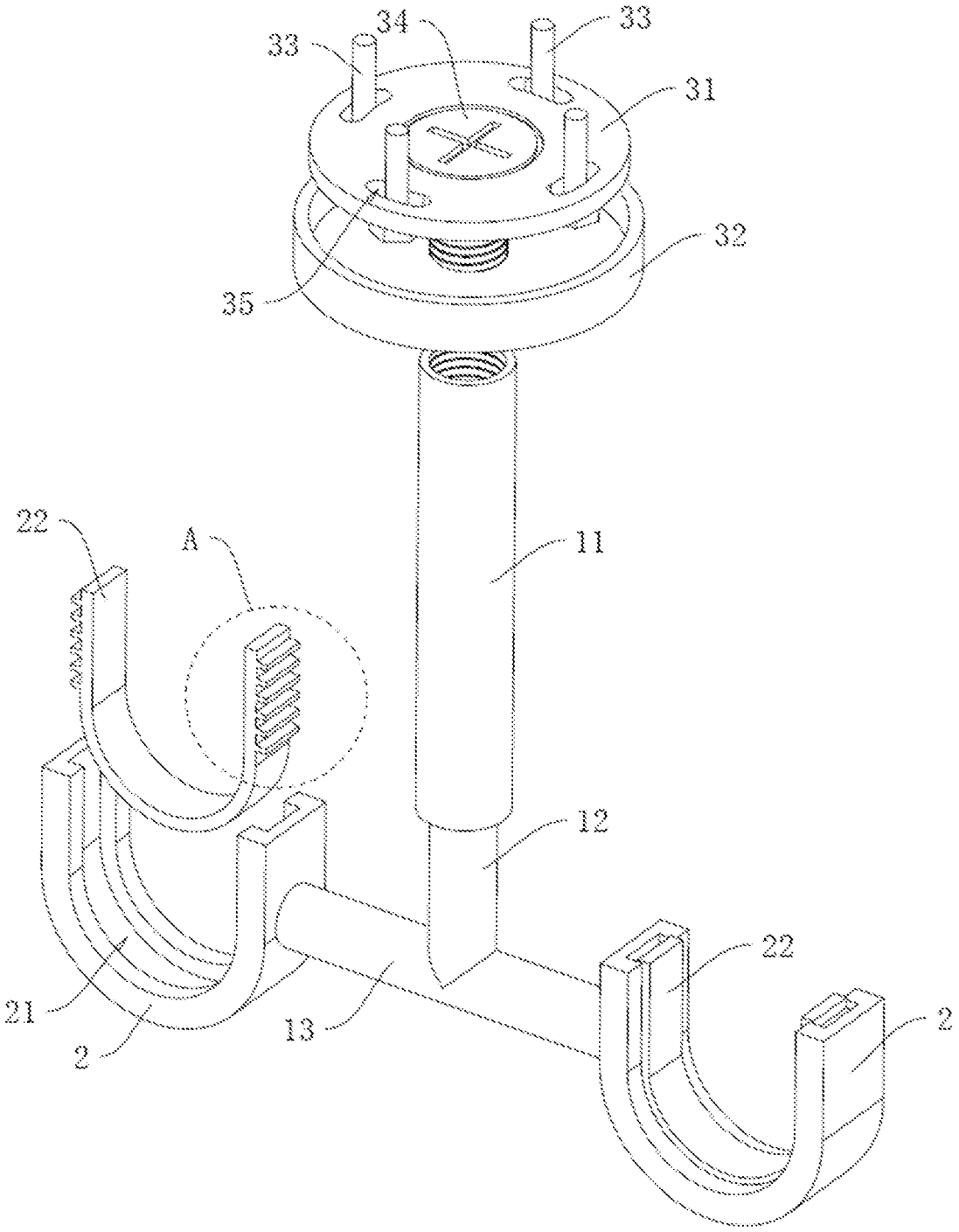
FIG. 3 is an explosion diagram of FIG. 2, which is used to show the structure of an adjusting pad and an installation assembly.

Referring to FIG. 2 and FIG. 3, a curtain rod hanging structure includes a vertical rod 1 and two hook bodies 2. The vertical rod 1 includes a fixing tube 11 with a circular section, a sliding rod 12 and a horizontal rod 13. The sliding rod 12 is slidably connected inside the fixing tube 11. The sliding rod 12 is in friction connection with the inner wall of the fixing tube 11. The middle of the horizontal rod 13 is fixedly connected with the end of the sliding rod 12 away from the ceiling. Two hook bodies 2 are corresponding to two ends of the horizontal rod 13 respectively. The hook body 2 is integrally formed on the end of the horizontal rod 13. A U-shaped installation groove 21 is provided on the inner wall of the hook body 2. The installation groove 21 is embedded with an adjusting pad 22 made of plastic. The adjusting pad 22 is of U shape and used for hanging the curtain rod.

Figure 4:
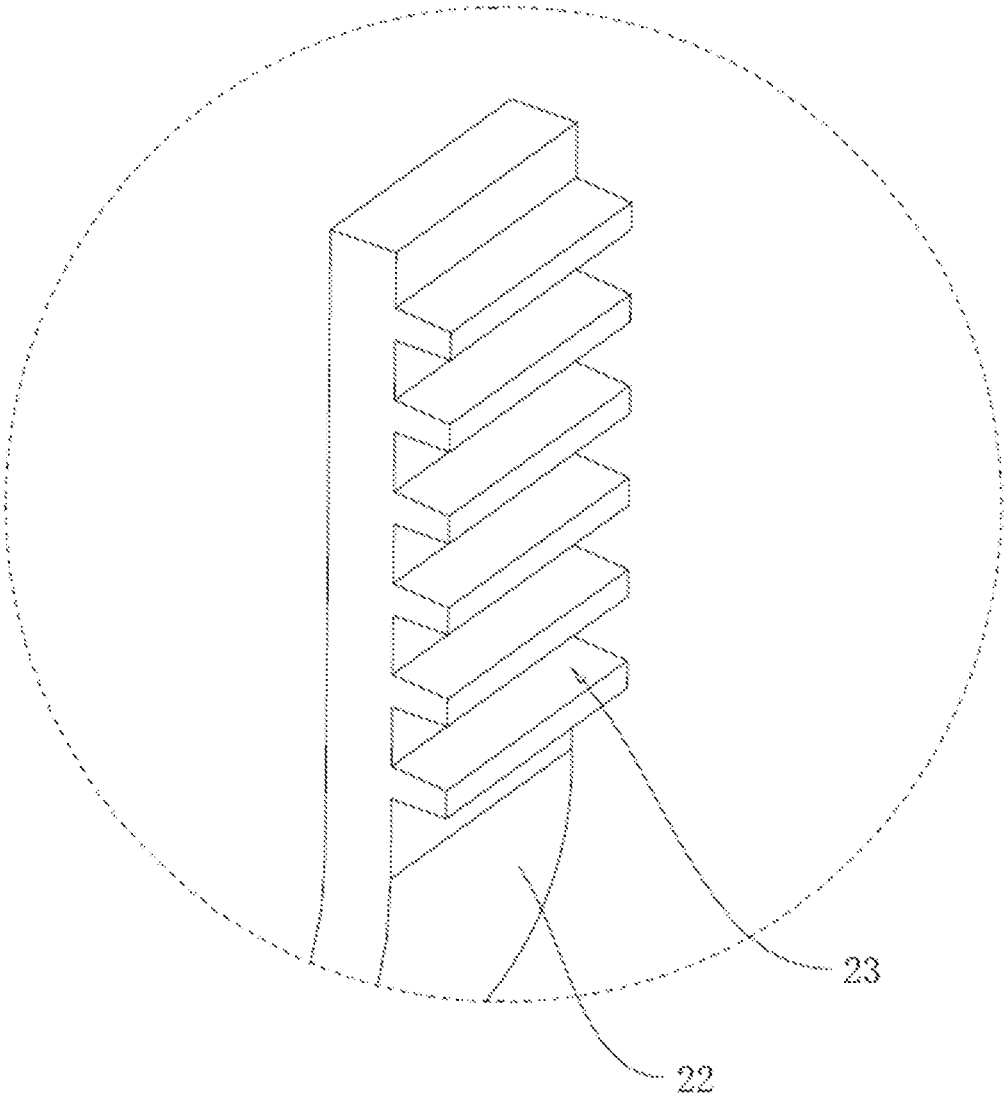
FIG. 4 is an enlarged diagram of Part A in FIG. 3, which is used to show an anti-slip groove.

Referring to FIG. 2 and FIG. 4, a plurality of anti-slip grooves 23 are provided on the sidewall of the adjusting pad 22 close to the bottom of the installation groove 21, and the anti-slip grooves 23 is evenly distributed along the length direction of the fixing tube 11.

Referring to FIG. 2 and FIG. 3, the fixing tube 11 is connected to the ceiling through an installation assembly 3. The installation assembly 3 includes an installation plate 31, a shielding cover 32, an expansion bolt 33 and a fixing screw 34. The installation plate 31 is positioned in the shielding cover 32. The fixing screw 34 is coaxial with the installation plate 31. The fixing screw 34 is in threaded connection with the installation plate 31. The tail of the fixing screw 34 penetrates the installation plate 31 and shielding cover 32, and is threadedly connected in the fixing tube 11. The head of the fixing screw 34 is positioned in the shielding cover 32. Four installation through-holes 35 are provided on the side of the installation plate 31 away from the ceiling. The installation through-holes 35 are of an arc shape. Four installation through-holes 35 are evenly and circumferentially distributed about the axis of the installation plate 31. The head of the expansion bolt 33 is positioned on the side of the installation through-hole 35 away from the ceiling, and the tail of the expansion bolt 33 penetrates the installation through-hole 35 and into the ceiling.

The implementing principle of Embodiment 1 is as follows. When installing, the fixing screw 34 is threadedly connected to the installation plate 31 by the operator, and then the tails of four expansion bolts 33 are penetrated into the ceiling, so that the operator can realize a certain fine adjustment by rotating the installation plate 31. The shielding cover 32 is sleeved on the installation plate 31, so that the fixing screw 34 penetrates out of the shielding cover 32, and then the fixing tube 11 is threadedly connected to the end of the fixing screw 34 penetrated out of the shielding cover 32. The adjusting pad 22 is replaced to match the curtain rod, and then the relative position between the sliding rod 12 and fixing rod is adjusted to realize the installation.

Embodiment 2

Figure 5:
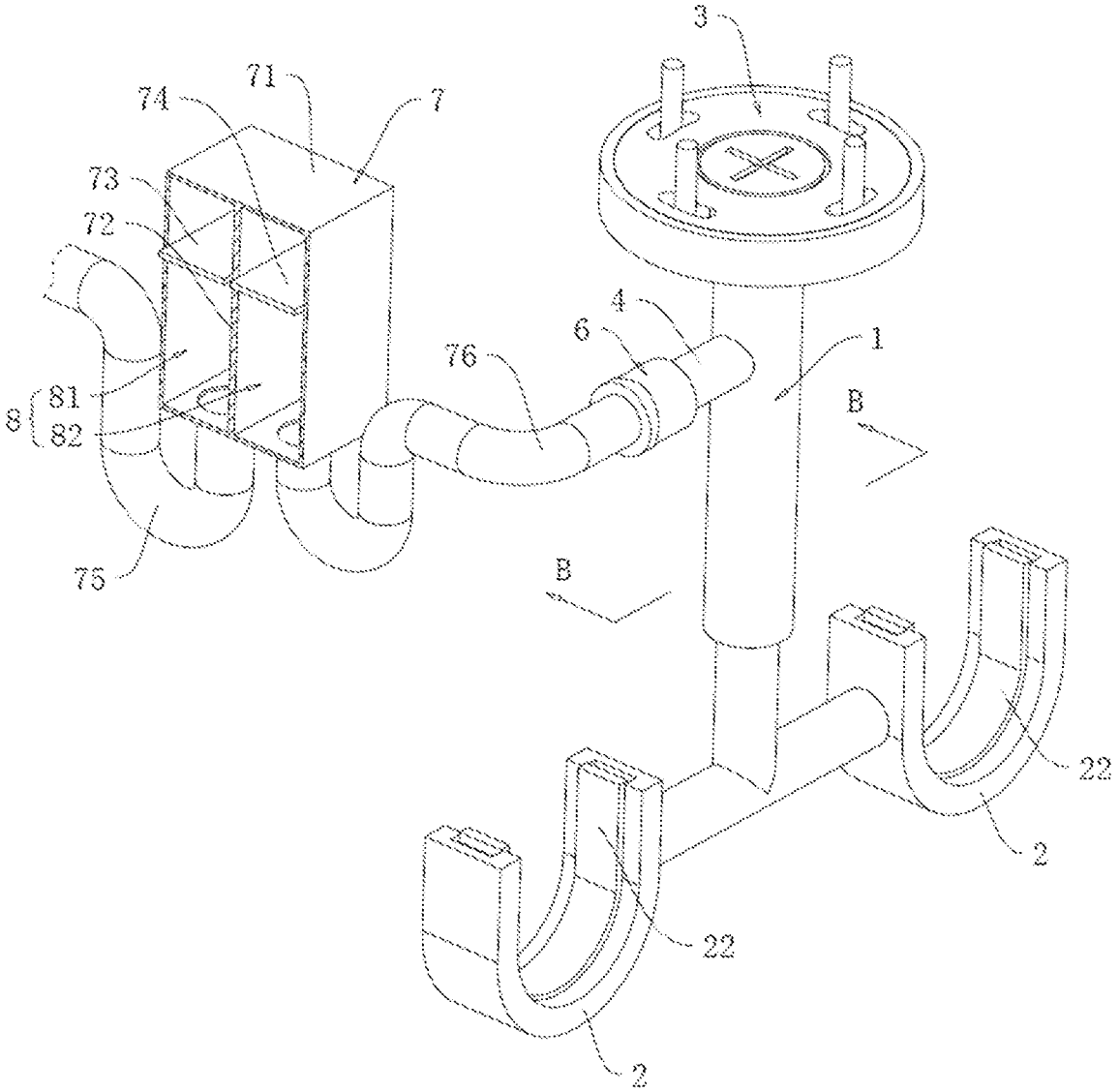
FIG. 5 is a section diagram of Embodiment 2 in the present application, which is used to show a structure inside the transparent box.
Figure 6:
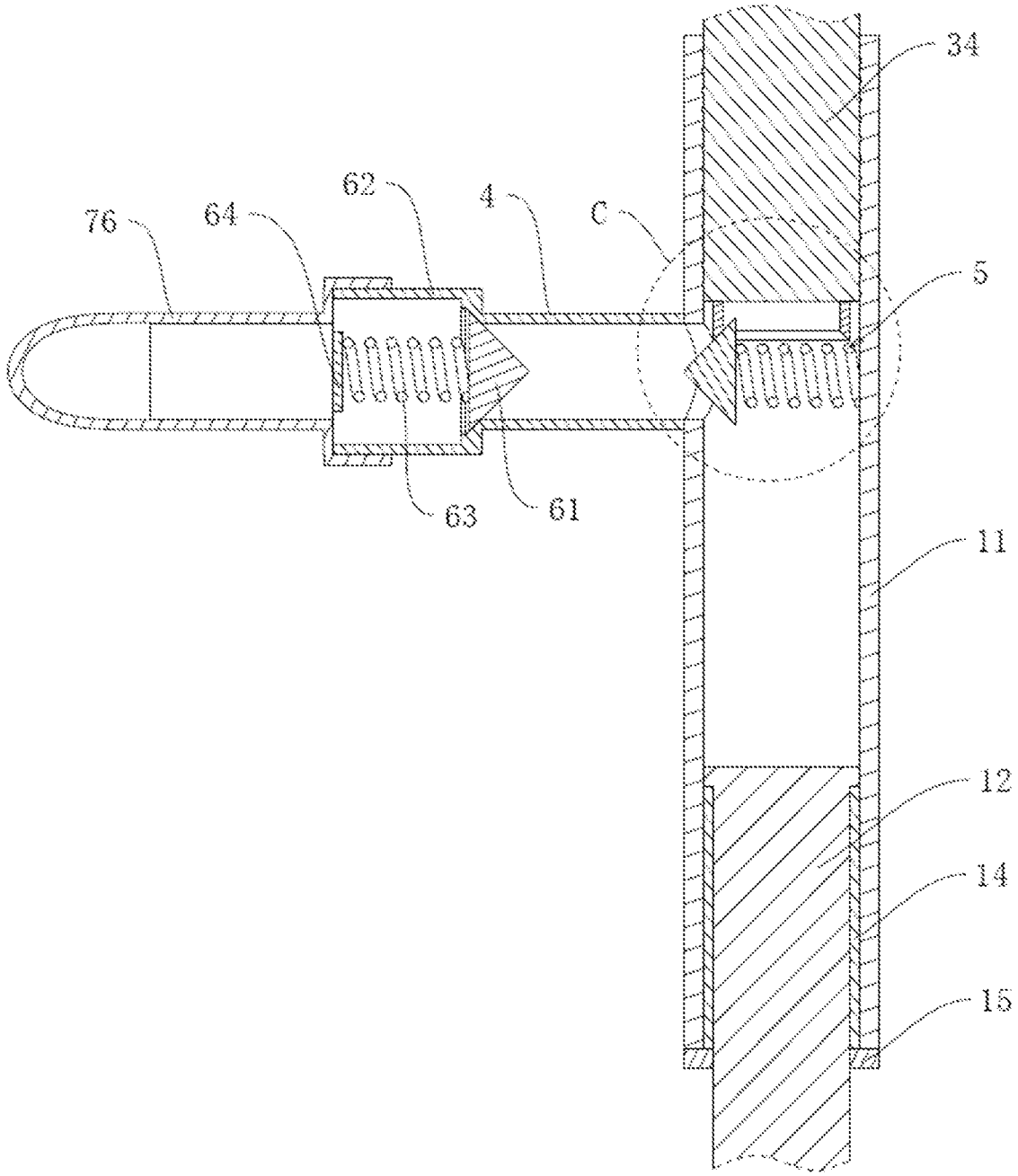
FIG. 6 is a section diagram along B-B in FIG. 5, which is used to show the structures of a unidirectional structure, a rubber ring and a block ring.

Referring to FIG. 5 and FIG. 6, this embodiment differs from Embodiment 1 in that. a rubber ring 14 is sleeved on the sliding rod 12. The rubber ring 14 is fixedly connected to the sliding rod 12 and the outer sidewall of the rubber ring 14 abuts against the inner sidewall of the fixing tube 11. A blocking ring 15 is fixedly connected to the end of the fixing tube 11 away from the fixing screw 34. A connecting tube 4 is fixedly connected to the outer sidewall of the fixing tube 11, the fixing tube 4 is communicated with the fixing tube 11, and is positioned between the fixing screw 34 and sliding rod 12.

Figure 7:
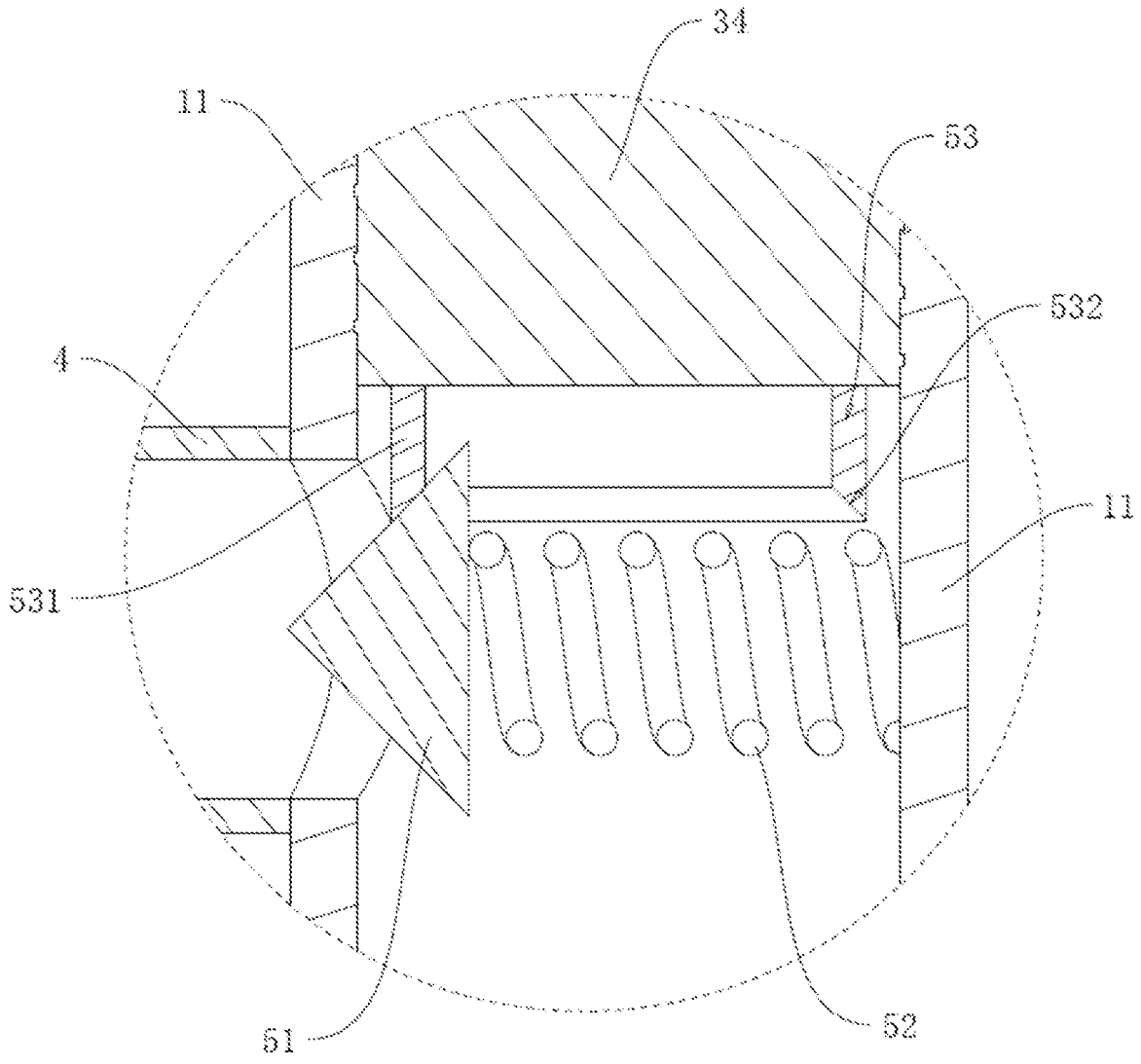
FIG. 7 is an enlarged diagram of Portion C in FIG. 6, which is used to show the structure of a closing assembly.

Referring to FIG. 6 and FIG. 7, a closing assembly 5 is provided at the communicating portion between the connecting tube 4 and fixing tube 11. The closing assembly 5 includes a tapered closing body 51, a return spring 52 for maintaining a closing state of the joint between the connecting tube 4 and fixing tube 11 by the tapered closing body 51, and a driving structure 53 for driving the tapered closing body 51 moving in the direction away from the connecting tube 4. The tapered closing body 51 is positioned on the side of the connecting tube 4 facing the fixing tube 11. The outer diameter of the tapered closing body 51 is gradually increased along the connecting tube 4 in the direction approaching the fixing tube 11, and the outer sidewall of the tapered closing body 51 is configured to close the communication portion between the connecting tube 4 and fixing tube 11. The length direction of the return spring 52 is parallel to the length direction of the connecting tube 4. One end of the return spring 52 is fixedly connected to the end of the tapered closing body 51 departing from the connecting tube 4, and anther end of the return spring 52 is fixedly connected to the inner wall of the fixing tube 11.

Referring to FIG. 6 and FIG. 7. the driving structure 53 includes a driving ring 531, the driving ring 531 is coaxial with the fixing screw 34, and is fixedly connected to the end of the fixing screw 34 close to the blocking ring 15, and a guiding slope is provided between the end of the driving ring 531 close to the blocking ring15 and the inner sidewall of the driving ring 531, which is used to abut against the outer sidewall of the tapered closing body 51.

When in use, the fixing tube 11 is threadedly connected to the fixing screw 34 by the operator, so that air between the fixing screw 34 and the sliding rod 12 drives the sliding rod 12 to slide to a limit position, and the blocking ring 15 blocks the sliding rod 12. When the operator continues to screw the fixing tube 11 to the fixing screw 34, the driving ring 531 moves in the direction approaching the tapered closing body 51, so that the outer sidewall of the tapered closing body 51 abuts against the guiding slope 532 of the driving ring 531, and the guiding slope 532 drives the tapered closing body 51 to move in the direction away from the connecting tube 4. Thereby, the communication portion between the connecting tube 4 and fixing tube 11 is opened by the tapered closing body 51.

Referring to FIG. 6, a unidirectional structure 6 is provided at the connecting tube 4 departing from the fixing tube 11. The unidirectional structure 6 includes a unidirectional tapered body 61, a unidirectional tube 62 and a unidirectional spring 63 for keeping the directional tapered body 61 closing the connecting tube 4. The end of the unidirectional tube 62 is fixedly and coaxially connected to the end of the connecting tube 4 away from the fixing tube 11. A fixing plate 64 is fixedly connected in the unidirectional tube 62, the unidirectional tapered body 61 is positioned between the fixing plate 64 and the connecting tube 4, and the outer diameter of the unidirectional tapered body 61 is gradually decreased along the direction from connecting tube 4 to fixing tube 11. The unidirectional spring 63 is positioned between the fixing plate 64 and the unidirectional tapered body 61, one end of the unidirectional spring 63 is fixedly connected to the fixing plate 64 and the other end of the unidirectional spring 63 is fixedly connected to the unidirectional tapered body 61, and the outer sidewall of the unidirectional tapered body 61 is configured to abut against the communication portion between the unidirectional tube 62 and the connecting tube 4.

When in use, the operator screws the fixing screw 34 into the fixing tube 11, so that the sliding rod 12 slides to the limit position, and then the driving ring 531 drives the tapered closing body 51 to open the connecting tube 4. The operator can press the sliding rod 12 along the direction approaching the fixing screw 34, so that the air between the fixing screw 34 and the sliding rod 12 is discharged through unidirectional tapered body 61. Since the external air is blocked by the unidirectional tapered body 61, the external air is hard to enter into the fixing tube 11, which can reduce the possibility of unintended sliding of the sliding rod 12 by the operator, and improves the overall stability during use.

Referring to FIG. 5 and FIG. 6, two curtain rod hanging structures are provided, and a leveling assembly 7 is provided between two connecting tubes 4. The leveling assembly 7 includes a transparent box 71, a partition plate 72, a first sliding plate 73 and a second sliding plate 74. The partition plate 72 is vertically arranged and fixedly connected in the transparent box 71, the partition plate 72 divides the transparent box 71 into two cavities 8, that is, a first cavity 81 and a second cavity 82, respectively. The first sliding plate 73 is slidably connected inside the first cavity 81, and the second sliding plate 74 is slidably connected inside the second cavity 82. A first communicating pipe 75 is fixedly connected with the bottom of the first cavity 81 inner wall, the first communicating pipe 75 is communicated with the first cavity 81, and the end of the first communicating pipe 75 away from the transparent box 71 is sleeved on one of the unidirectional tubes 62. A second communicating pipe 76 is fixedly connected on the inner bottom wall of the second cavity 82, the second communicating pipe 76 is communicated with the second cavity 82, and the end of the second communicating pipe 76 away from the transparent box 71 is sleeved on the other of the unidirectional tubes 62. The first communicating pipe 75 and the second communicating pipe 76 are both made of rubber.

When in use, the operator installs two curtain rod hanging structures on the ceiling, then screws the fixing screw 34 into the fixing tube 11, so that the sliding rod 12 slides to the limit position in the fixing tube 11, and then the driving ring 531 drives the tapered closing body 51 to open the connecting tube 4. After standing for a period of time to balance the internal air pressure with the external air pressure, the first communicating pipe 75 is sleeved on one of the unidirectional tubes 62 and the second communicating pipe 76 is sleeved on another unidirectional tube 62. When the operator adjusts the extension length of one sliding rod 12, air extruded by the sliding rod 12 enters the first cavity 81 via the unidirectional tapered body 61, the unidirectional tube 62 and the first communicating pipe 75, so that the first sliding plate 73 in the first cavity 81 is lifted. When the operator adjusts the extension length of another sliding rod 12, the operator only needs to observe the heights of the second sliding plate 74 and the first sliding plate 73, so as to realize the leveling of the curtain rod, which facilitates the operation for operator.

The implementing principle of Embodiment 2 is as follows. When in use, the operator screws the fixing screw 34 into the fixing tube 11, so that air between the fixing screw 34 and the sliding rod 12 drives the sliding rod 12 to slide to the limit position, thereby realizing "zero adjustment" of the sliding rod 12. After standing for a period of time, the air pressure inside the fixing tube 11 is stabilized with the external air pressure, and the two unidirectional tubes 62 are connected with each other by the first communicating pipe 75 and the second communicating pipe 76. When the operator adjusts one of the sliding rods 12, the air inside the fixing tube 11 lifts the first sliding plate 31, and when adjusting the other sliding rod 12, the air discharged from the fixing tube 11 lifts the second sliding plate 74. The operator can realize the leveling of the curtain rods through heights of the first sliding plate 73 and second sliding plate 74.

The above are the preferred embodiments of the present application, which are not intend to limit the protection scope of the present application. Therefore, all equivalent changes made according to the structure, shape and principle of the present application should be covered within the protection scope of the present application.

What is claimed is:

1. A curtain rod hanging structure, comprising: a vertical rod and a hook body, wherein the hook body is provided on the vertical rod, an installation groove is provided on an inner wall of the hook body, and an adjusting pad is detachably arranged in the installation groove and the adjusting pad is configured to hang the curtain rod; the vertical rod comprises a fixing tube and a sliding rod, wherein the sliding rod is slidably connected inside the fixing tube, and the sliding rod is in friction connection with the inner wall of the fixing tube, and the hook body is arranged on the sliding rod; the fixing tube is provided with an installation assembly, the installation assembly comprises an installation plate and a fixing screw, the installation plate is provided with a plurality of installation through-holes, the fixing screw is threadedly connected on the installation plate, the fixing screw penetrates the installation plate and the fixing tube is threadedly connected with the fixing screw; wherein a connecting tube is provided on a sidewall of the fixing tube, the connecting tube is communicated with the fixing tube, a unidirectional structure is provided in the connecting tube, the unidirectional structure comprises a unidirectional tapered body and a unidirectional spring for keeping the unidirectional tapered body closing the connecting tube, the unidirectional tapered body is slidably connected in the connecting tube in the direction approaching or departing from the fixing tube, and the outer diameter of the unidirectional tapered body is gradually increased along the direction from the fixing tube to the connecting tube.

2. The curtain rod hanging structure according to claim 1, wherein the adjusting pad is elastic, and is snap connected in the installation groove.

3. The curtain rod hanging structure according to claim 1, wherein a plurality of anti-slip grooves are provided on a sidewall of the adjusting pad close to an inner wall of the hook body.

4. The curtain rod hanging structure according to claim 1, wherein a rubber ring is provided on an outer sidewall of the sliding rod, and an outer wall of the rubber ring abuts against the inner wall of the fixing tube.

5. The curtain rod hanging structure according to claim 1, wherein a closing assembly is provided between the connecting tube and the fixing tube, the closing assembly comprises a tapered closing body, a return spring for keeping the tapered closing body closing a communicating portion between the connecting tube and the fixing tube, and a driving structure for driving the tapered closing body to move in the direction away from the connecting tube, and the outer diameter of the tapered closing body is gradually decreased along the direction from fixing tube to connecting tube.

6. The curtain rod hanging structure according to claim 5, wherein the driving structure comprises a driving ring, the driving ring is arranged at a tail of the fixing screw, and the driving ring is configured to abut against the sidewall of the tapered closing body.

7. The curtain rod hanging structure according to claim 6, wherein a leveling assembly is provided in the connecting tube, the leveling tube comprises a transparent box, a partition plate, a first sliding plate and a second sliding plate, the partition plate is fixedly connected inside the transparent box, the partition plate divides the transparent box into two cavities, including a first cavity and a second cavity, the first sliding plate is slidably connected inside the first cavity, the second sliding plate is slidably connected inside the second cavity, a first communicating pipe is communicated with the bottom of the first cavity inner wall, a second communicating pipe is communicated with an inner bottom wall of the second cavity, and the first communicating pipe is configured to communicate with the connecting tube.

* * * * *